US011657936B2

(12) United States Patent
Tanada et al.

(10) Patent No.: US 11,657,936 B2
(45) Date of Patent: May 23, 2023

(54) WINDING-TYPE COIL COMPONENT AND METHOD FOR MANUFACTURING SAME, AS WELL AS CIRCUIT BOARD CARRYING WINDING-TYPE COIL COMPONENT

(71) Applicant: TAIYO YUDEN CO., LTD., Tokyo (JP)

(72) Inventors: Atsushi Tanada, Takasaki (JP); Toshimasa Suzuki, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 451 days.

(21) Appl. No.: 16/820,350

(22) Filed: Mar. 16, 2020

(65) Prior Publication Data

US 2020/0312503 A1 Oct. 1, 2020

(30) Foreign Application Priority Data

Mar. 28, 2019 (JP) ..... JP2019-062471

(51) Int. Cl.

| | |
|---|---|
| ***H01F 1/33*** | (2006.01) |
| ***H01F 1/147*** | (2006.01) |
| ***H01F 27/28*** | (2006.01) |
| ***H01F 27/255*** | (2006.01) |
| ***H01F 1/24*** | (2006.01) |
| ***H01F 27/29*** | (2006.01) |
| ***H01F 17/04*** | (2006.01) |

(52) U.S. Cl.

CPC ..... *H01F 1/33* (2013.01); *H01F 1/14791* (2013.01); *H01F 1/24* (2013.01); *H01F 27/255* (2013.01); *H01F 27/2823* (2013.01); *H01F 27/292* (2013.01); *H01F 17/045* (2013.01); *H01F 2017/048* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 10,468,174 | B2 * | 11/2019 | Mihara | H01F 17/04 |
| 11,302,466 | B2 * | 4/2022 | Suzuki | H01F 17/04 |
| 2006/0027950 | A1 * | 2/2006 | Ishitani | B22F 1/145 264/613 |
| 2012/0274437 | A1 * | 11/2012 | Matsuura | H01F 1/24 336/221 |
| 2015/0332850 | A1 * | 11/2015 | Nishio | C22C 38/00 336/221 |
| 2016/0336104 | A1 * | 11/2016 | Noguchi | C22C 33/0257 |

(Continued)

FOREIGN PATENT DOCUMENTS

| | | | |
|---|---|---|---|
| JP | 2013045927 | A | 3/2013 |
| JP | 2018046287 | A | 3/2018 |

*Primary Examiner* — Kevin M Bernatz

(74) *Attorney, Agent, or Firm* — Law Office of Katsuhiro Arai

(57) ABSTRACT

A winding-type coil component whose core member is constituted by: soft magnetic alloy grains 210 containing Fe, Si, and at least one of Cr and Al, as constituent elements; and an oxide layer 220 which is formed around the soft magnetic alloy grains to bond the soft magnetic alloy grains together and contains Si, as well as at least one of Cr and Al, as constituent elements, and whose content of Si based on mass is higher than the total content of Cr and Al. The winding-type coil component has high mechanical strength.

6 Claims, 3 Drawing Sheets

(56) References Cited

U.S. PATENT DOCUMENTS

| | | | | |
|---|---|---|---|---|
| 2017/0162307 | A1* | 6/2017 | Ishida | H01F 41/0246 |
| 2017/0207017 | A1* | 7/2017 | Noguchi | H01F 41/0246 |
| 2017/0287605 | A1* | 10/2017 | Tanada | H01F 1/14766 |
| 2018/0061550 | A1* | 3/2018 | Lee | H01F 1/33 |
| 2018/0137959 | A1* | 5/2018 | Saigusa | H01F 1/14791 |
| 2018/0315528 | A1* | 11/2018 | Nanbara | C22C 38/02 |
| 2019/0333666 | A1* | 10/2019 | Nakamura | H01F 7/021 |
| 2020/0279676 | A1* | 9/2020 | Orimo | C22C 38/06 |
| 2020/0312522 | A1* | 10/2020 | Kurahashi | H01F 27/2804 |
| 2020/0316683 | A1* | 10/2020 | Takahashi | B22F 3/24 |
| 2021/0304946 | A1* | 9/2021 | Ishida | H01F 1/24 |

* cited by examiner

Cross-Section A-A

WINDING-TYPE COIL COMPONENT AND METHOD FOR MANUFACTURING SAME, AS WELL AS CIRCUIT BOARD CARRYING WINDING-TYPE COIL COMPONENT

CROSS-REFERENCE TO RELATED APPLICATIONS

The present application claims priority to Japanese Patent Application No. 2019-062471, filed Mar. 28, 2019, the disclosure of which is incorporated herein by reference in its entirety including any and all particular combinations of the features disclosed therein.

BACKGROUND

Field of the Invention

The present invention relates to a winding-type coil component and a method for manufacturing the same, as well as a circuit board carrying a winding-type coil component.

Description of the Related Art

In recent years, coil components for applications such as those where they must carry large current, are facing calls for size reduction as well as further increase in current capacity. Since increasing the current capacity of a coil component requires constituting its core using a magnetic material having magnetic-saturation resistance to current, there has been a growing use of ferrous metal magnetic materials—instead of ferritic materials—as the magnetic materials for this purpose.

Known, as coil components having a structure favorable for size reduction, are winding-type coil components of a structure wherein a coil conductive wire is wound around a core formed by a magnetic body, with both ends of the coil conductive wire connected to a pair of terminal electrodes provided on the surface of the core (Patent Literatures 1 and 2). Here, the magnetic body core has a so-called drum-type shape having a winding core part and a pair of flange parts provided on the top edge and bottom edge of the winding core part.

When a drum-type core is formed using a metal magnetic material, normally it is provided as a powder compact. This compact has a structure wherein grains of a metal magnetic material are bonded together via an oxide layer, and is known to be porous and have a higher porosity than a ferrite core (Patent Literature 2). In Patent Literature 2, it is reported that a compact was pre-impregnated or pre-coated with a penetration inhibitor to fill porous parts for the purpose, for example, of preventing the electrode material from penetrating into the voids when the terminal electrodes are formed, because the core is porous.

BACKGROUND ART LITERATURES

[Patent Literature 1] Japanese Patent Laid-open No. 2013-45927

[Patent Literature 2] Japanese Patent Laid-open No. 2018-46287

SUMMARY

Core porosification, resulting from changing the material with which to constitute the core from ferritic to metallic, not only causes the aforementioned penetration of the electrode material, but also causes the strength of the core to drop. This makes the core prone to chipping, cracking, and other handling damage when the coil conductive wire is wound, the component is mounted on a circuit board, and so on. In particular, a winding-type coil component having a drum-type core, whose flange parts project from its winding core part, presents a problem in that the flange parts crack or chip easily.

Accordingly, an object of the present invention is to solve the aforementioned problems and provide a winding-type coil component of high mechanical strength.

After conducting various studies to solve the aforementioned problems, the inventor of the present invention found that the problems could be solved by adopting a specific composition for the grains of the magnetic alloy that constitute the core, and also by constituting the grains of the alloy to bond together via an oxide layer having a specific composition, and eventually completed the present invention.

To be specific, a first aspect of the present invention to solve the aforementioned problems is a winding-type coil component comprising: a core member having a winding core part of a columnar shape; a coil conductive wire wound around the winding core part of the core member; and a pair of terminal electrodes, each constituted by either an end part of the core conductive wire or a metal part to which the end part is connected; wherein such winding-type coil component is characterized in that the core member is constituted by: soft magnetic alloy grains containing Fe, Si, and at least one of Cr and Al, as constituent elements; and an oxide layer which is formed around the soft magnetic alloy grains to bond the soft magnetic alloy grains together and contains Si, as well as at least one of Cr and Al, as constituent elements, and whose content of Si based on mass is higher than the total content of Cr and Al.

Also, a second aspect of the present invention is a method for manufacturing winding-type coil component comprising: a core member having a winding core part of a columnar shape; a coil conductive wire wound around the winding core part of the core member; and a pair of terminal electrodes, each constituted by either an end part of the core conductive wire or a metal part to which the end part is connected; wherein such method for manufacturing winding-type coil component includes: preparing a soft magnetic alloy powder which contains Fe, Si, and at least one of Cr and Al, as constituent elements and whose content of Si is higher than the total content of Cr and Al; compacting the soft magnetic alloy powder to obtain a compact corresponding to the shape of the core member; heat-treating the compact in an atmosphere of 5 to 800 ppm in oxygen concentration at a temperature of 500 to 900° C. to form an oxide layer on the surfaces of soft magnetic alloy grains, thereby causing the soft magnetic alloy grains to bond together via the oxide layer, to obtain a core member; forming a pair of terminal electrodes, each using either an end part of the coil conductive wire or the metal part; and winding the coil conductive wire around the winding core part of the core member.

Furthermore, a third aspect of the present invention is a circuit board carrying the aforementioned winding-type coil component.

According to the present invention, a winding-type coil component of high mechanical strength can be provided.

BRIEF DESCRIPTION OF THE DRAWINGS

(FIG. 1A: General perspective view, FIG. 1B: View of section A-A in FIG. 1A).

(FIG. 1A: Confirmed result of the structure of the oxide layer, using a scanning transmission electron microscope (STEM), regarding a test piece pertaining to an example, FIG. 1B: Drawing explaining the structure of the inter-grain bonding part).

DESCRIPTION OF THE SYMBOLS

Figure 1A:
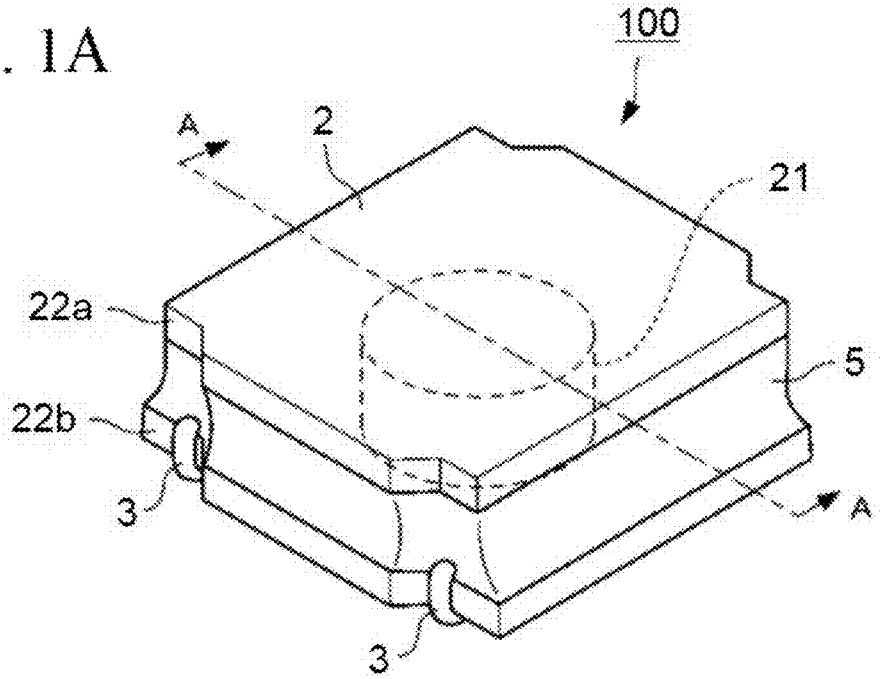
FIGS. 1A and 1B are schematic views showing the overall structure of the winding-type coil component pertaining to the first aspect of the present invention

| | |
|---|---|
| 100 | Winding-type coil component |
| 2 | Core member |
| 21 | Winding core part |
| 22a, 22b | Flange part |
| 210 | Soft magnetic alloy grain |
| 220 | Oxide layer |
| 221 | Si-enriched area |
| 222 | Si-rich area |
| 230 | Fe-rich layer |
| 3 | Coil conductive wire |
| 31a, 31b | End part of a coil conductive wire |
| 4a, 4b | Terminal electrode |
| 5 | Exterior member |
| A-A' | Location where line analysis was conducted |

DETAILED DESCRIPTION OF EMBODIMENTS

The constitutions as well as operations and effects of the present invention are explained below, together with the technical ideas, by referring to the drawings. It should be noted, however, that the mechanisms of operations include estimations and whether they are right or wrong does not limit the present invention in any way. Also, of the components in the aspects below, those components not described in the independent claims representing the most generic concepts are explained as optional components. It should be noted that a description of numerical range (description of two values connected by "to") is interpreted to include the described values as the lower limit and the upper limit.

[Winding-Type Coil Component]

The winding-type coil component pertaining to the first aspect of the present invention (hereinafter also referred to simply as "first aspect") comprises: a core member having a winding core part of a columnar shape; a coil conductive wire wound around the winding core part of the core member; and a pair of terminal electrodes, each constituted by either an end part of the core conductive wire or a metal part to which the end part is connected. Also, the core member is constituted by: soft magnetic alloy grains containing Fe, Si, and at least one of Cr and Al, as constituent elements; and an oxide layer which is formed around the soft magnetic alloy grains to bond the soft magnetic alloy grains together and contains Si, as well as at least one of Cr and Al, as constituent elements, and whose content of Si based on mass is higher than the total content of Cr and Al.

Figure 1B:
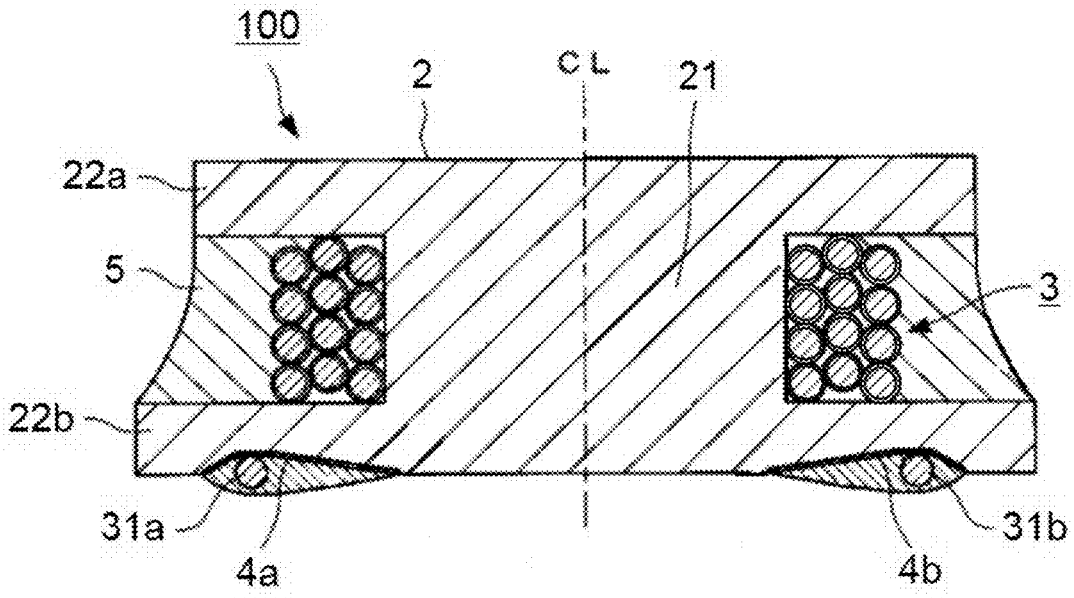

First, the overall structure of the first aspect is explained by referring to FIGS. 1A and 1B.

The winding-type coil component 100 pertaining to the first aspect comprises a core member 2 having a winding core part 21 of a columnar shape, a coil conductive wire 3 wound around the winding core part 21 of the core member 2, and a pair of terminal electrodes 4*a*, 4*b* to which both end parts of the core conductive wire 3 are connected. Since the illustrated coil component 100 is a drum core-type coil component having an exterior part, the core member 2 further has a pair of flange parts 22*a*, 22*b* provided at both ends of the winding core part 21 of a columnar shape, and the pair of terminal electrodes 4*a*, 4*b* are provided on the exterior surfaces of the flange parts 22*a*, 22*b*. Also, the coil component 100 further has an exterior member 5 covering the outer periphery of the winding core part 21 and that of the coil conductive wire 3. This exterior member 5 may be a composite magnetic material made from a resin and a magnetic material, or it may be a sintered magnetic material.

The core member 2 comprises the winding core part 21 around which the coil conductive wire 3 is wound, the top flange part 22*a* provided at the top edge of the winding core part, and the bottom flange part 22*b* provided at the bottom edge of the winding core part, and has a drum-type shape in appearance. The shape of the core member 2 is not limited in any way to the shape of the core member 2 of the winding-type coil component 100 as illustrated, so long as it has the winding core part 21 around which the coil conductive wire 3 is wound, and it may be a T-type core, I-type core, or the like.

The shape of the winding core part 21 is not limited in any way, but in the sense that it can shorten the length of the coil conductive wire 3 needed to achieve a prescribed number of windings when the coil conductive wire 3 is wound, preferably it is one having a circular or roughly circular cross-section.

The flange parts 22*a*, 22*b* are not essential, and when they are provided, their shape is not limited in any way. When the core member 2 has the flange parts 22*a*, 22*b*, preferably their shape is quadrangular or roughly quadrangular in plan view as viewed from the axial direction of the winding core part 21, in the sense that it allows for high-density mounting on a circuit board. Also, preferably the top flange part 22*a* is constituted to be equal in size as, or slightly smaller than, the bottom flange part 22*b*. Furthermore, preferably the apexes of the top flange part 22*a* are chamfered, in the sense that it makes the below-mentioned filling of the exterior member 5 easier.

As described above, providing the flange parts 22*a*, 22*b* at the top edge and bottom edge of the winding core part 21 facilitates the control of the winding position of the coil conductive wire relative to the winding core part 21, which in turn allows for stabilization of the characteristics of the winding-type coil component 100.

The coil conductive wire 3 is wound around the winding core part 21 of the core member 2, while both its end parts 31*a*, 31*b* are electrically connected, via a solder, etc., to the terminal electrodes 4*a*, 4*b* constituted by metal parts. Both end parts 31*a*, 31*b* of the coil conductive wire 3 may directly constitute the terminal electrodes 4*a*, 4*b*, or one end part 31*a* of the coil conductive wire 3 may constitute one terminal electrode 4*a* and a metal part to which the other end part 31*b* is connected may constitute the other terminal electrode 4*b*.

The coil conductive wire 3 uses a sheathed conductive wire constituted by a metal wire made of copper, silver, etc., having an insulating film of polyurethane resin, polyester resin, etc., formed on its outer periphery, with the insulating film removed at both end parts 31*a*, 31*b*. The diameter and length of the coil conductive wire 3 only need to be determined as deemed appropriate according to the characteristics required of the winding-type coil component 100, where an example is a wire having a diameter of 0.1 to 0.2 mm and whose length allows for winding around the winding core part 21 by 3.5 to 15.5 turns. Also, the metal wire positioned at the cross-section center of the coil conductive wire 3 is not limited in shape, either, and it may be a single wire, a combination of two or more wires, or a twisted wire, whose cross-section shape is circular, or it may be a rectangular wire with an oblong cross-section or a quadrangular wire with a square cross-section.

The terminal electrodes 4*a*, 4*b* are each constituted by either an end part 31*a* or 31*b* of the coil conductive wire 3 or a metal part to which the end part is connected. Then, when the winding-type coil component 100 is mounted on a circuit board, etc. (not illustrated), the terminal electrodes 4*a*, 4*b* are electrically connected to the circuit board, etc. As a result, the terminal electrodes 4*a*, 4*b* will supply current to the coil conductive wire 3 from the circuit board, etc. When both end parts 31*a*, 31*b* of the coil conductive wire 3 directly constitute the terminal electrodes 4*a*, 4*b*, the end parts 31*a*, 31*b* are electrically connected, directly, to the circuit board, etc. (not illustrated) on which the winding-type coil component 100 is mounted. Also, when one end 31*a* of the coil conductive wire 3 and a metal part to which the other end part 31*b* is connected constitute the terminal electrodes 4*a*, 4*b*, these terminal electrodes 4*a*, 4*b* are electrically connected, respectively, to the circuit board, etc. (not illustrated) on which the winding-type coil component 100 is mounted.

The positions and shape of the terminal electrodes 4*a*, 4*b* only need to be determined as deemed appropriate according to how they are connected to the coil conductive wire 3, circuit board, etc. Also, when a metal part is used for either terminal electrode 4*a* or 4*b*, its material is not limited in any way, either, and silver (Ag), Ag—Pd alloy, Ag—Pt alloy, copper (Cu), Ti—Ni—Sn alloy, Ti—Cu alloy, Cr—Ni—Sn alloy, Ti—Ni—Cu alloy, Ti—Ni—Ag alloy, Ni—Sn alloy, Ni—Cu alloy, Ni—Ag alloy, phosphor bronze, etc., can be used, for example.

The first aspect may have, as shown in FIGS. 1A and 1B, an exterior member 5 covering the winding core part 21 of the core member 2 and the coil conductive wire 3. The exterior member 5 is formed in a manner connecting the opposing flange parts 22*a*, 22*b* of the core member 2, or it is formed in a manner filling the space on the exterior side of the coil conductive wire 3. In the first aspect, the exterior member 5 is not essential because a sheathed conductive wire on which an insulating film has been formed is used as the coil conductive wire 3. However, since the exterior member 5 has the functions to protect the coil conductive wire 3 wound around the winding core part 21 and to further inhibit short-circuit failures, etc., preferably it is formed depending on the purpose of use. Additionally, when the exterior member 5 is to contain a magnetic powder, a function to improve the magnetic properties of the winding-type coil component 100 can also be added to the exterior member 5 as it serves as a passage for magnetic field.

The material for the exterior member 5 is not limited in any way, so long as the aforementioned functions are provided, and any of various resins such as silicon resins and epoxy resins may be used, for example. As for such resins, those having a glass transition temperature of 100 to 150° C. are preferred. When forming the exterior member 5 with a resin, silica or other inorganic filler may be added to improve the heat resistance or adjust the thermal expansion coefficient.

When the exterior member 5 is to contain a magnetic powder, a powder of any of various magnetic materials, such as an Fe—Cr—Si alloy powder, Mn—Zn ferrite powder, or Ni—Zn ferrite powder, may be used as the magnetic powder. Among these magnetic powders, preferably one having the same composition as the soft magnetic alloy grains constituting the core member 2 is used, from the viewpoint of achieving high magnetic permeability. Preferably the average grain size of the magnetic powder used is approx. 2 to 30 μm. Also, preferably the content of magnetic powder is approx. 50 percent by volume or more.

Figure 2A:
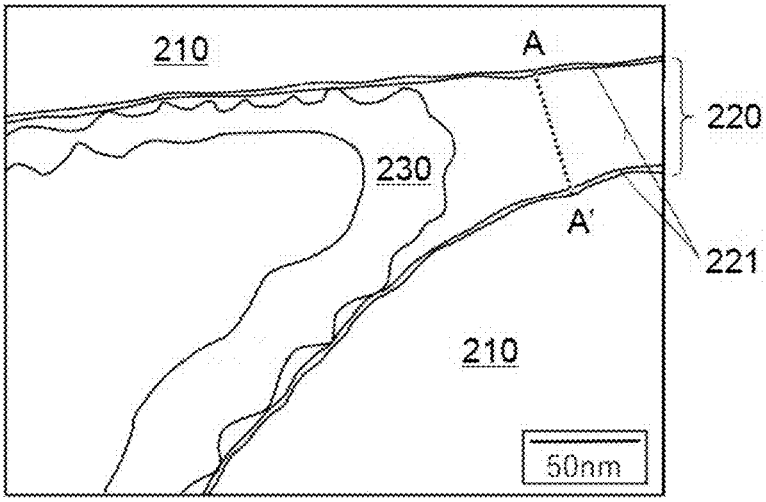
FIGS. 2A and 2B are schematic views showing the microstructure of the core member of the winding-type coil component pertaining to the first aspect of the present invention
Figure 2B:
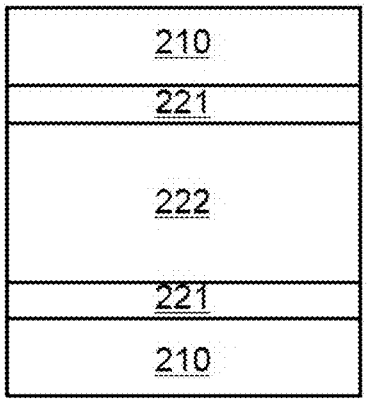

Next, the microstructure of the core member 2 in the first aspect is explained by referring to FIGS. 2A and 2B.

The soft magnetic alloy grains 210 constituting the core member 2 contain Fe, Si, and at least one of Cr and Al, as constituent elements.

Because the soft magnetic alloy grains 210 contain Si, the electrical resistance will increase and lowering of the magnetic properties due to eddy current can be inhibited. Preferably Si is present more abundantly on the surface side of the soft magnetic alloy grain 210 than on the inside thereof. Specifically, this means that the maximum value of Si quantity in a range of distances 0 to 50 nm as measured from the surface of the metal part, toward the interior side, of the soft magnetic alloy grain 210, is greater than the maximum value of Si content in a range of distances 100 to 150 nm as measured from the surface of the metal part, toward the interior side, of the soft magnetic alloy grain 210. Also, because the soft magnetic alloy grains 210 contain at least one of Cr and Al, excellent oxidation resistance will be achieved. Preferably Cr and Al in the soft magnetic alloy grain 210 are present more abundantly on the surface side of the grain than on the inside thereof.

The composition of the soft magnetic alloy grain 210 is not limited in any way, so long as the aforementioned requirements are satisfied, and it may be, for example, one where Si is contained by 1 to 10 percent by mass, Cr, if contained, is contained by 0.5 to 5 percent by mass, and Al, if contained, is contained by 0.2 to 3 percent by mass, with Fe and unavoidable impurities (including, e.g., oxygen, hydrogen, nitrogen and unavoidable metal element impurities) accounting for the remainder. To inhibit segregation of Cr and Al in the alloy part to achieve particularly excellent magnetic properties, the total quantity of Cr and Al is adjusted preferably to 4 percent by mass or less, or more preferably to 2 percent by mass or less. Furthermore, it is particularly preferred that, if the alloy part contains Al, its content is adjusted to 1 percent by mass or less, because Al is more easily oxidized on the grain surface than is Cr.

It should be noted that, needless to say, the soft magnetic alloy grain 210 may contain elements other than those mentioned above.

In the core member 2, the soft magnetic alloy grains 210 having the aforementioned composition are bonded together via an oxide layer 220 which contains Si, as well as at least one of Cr and Al, and whose content of Si based on mass is higher than the total content of Cr and Al.

Figure 4:
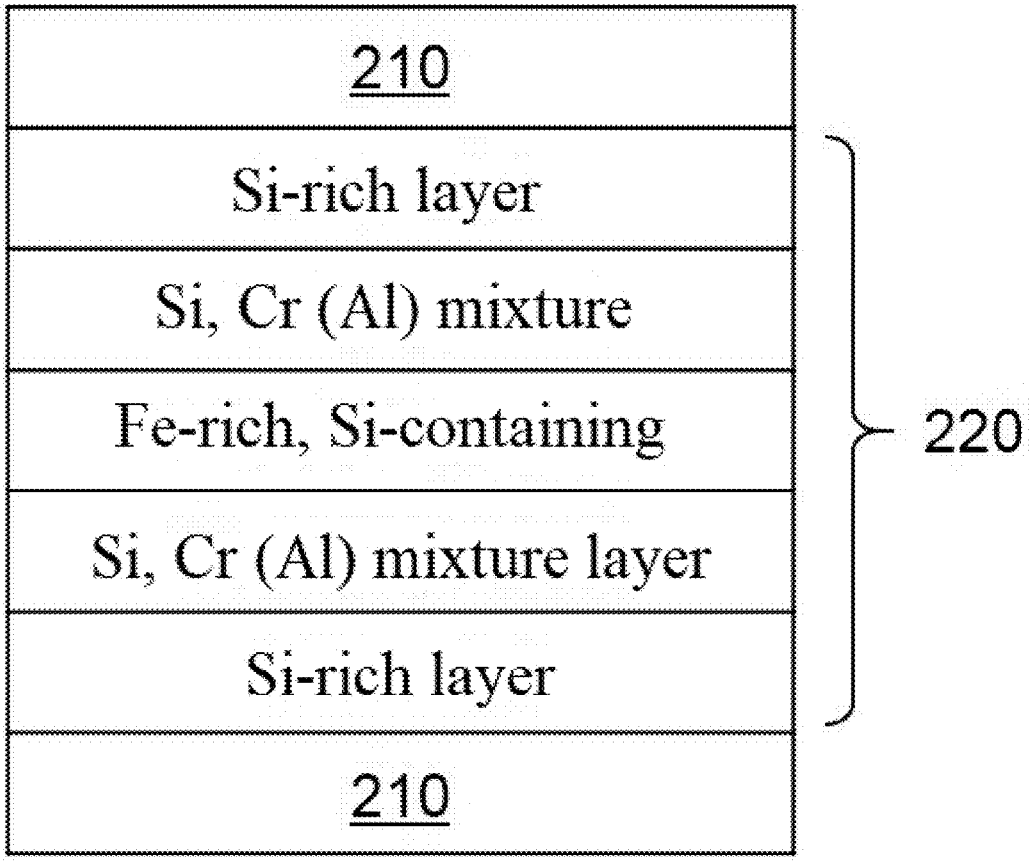
FIG. 4 is a drawing explaining the structure, in the core member, of the inter-grain bonding part at the oxide layer obtained by heat treatment in the air.

Having such structure allows the core member 2 to have improved strength, so that cracking, chipping, and other handling damage, especially damage to the flange parts 22*a*, 22*b* in the case of a drum-type core, can be prevented. The mechanism behind this strength improvement, although unclear, is deduced as follows. The oxide layer in the core member that has been heat-treated in the air generally has a five-layer structure of (Si-rich layer)/(Si, Cr (Al) mixture layer)/(Fe-rich, Si-containing layer)/(Si, Cr (Al) mixture layer)/(Si-rich layer), as shown in FIG. 4 that schematically illustrates the structure of the inter-grain bonding part, and its thickness is also as much as around 100 nm between the grains. This means that, when shearing or tensile stress is applied, peeling or sliding deformation will occur easily at the interface of each layer. The oxide layer 220 in the first aspect having the aforementioned characteristics, on the other hand, has a small number of component layers, or three layers to be specific, and the whole layer between the grains is also thin, as shown in FIGS. 2A and 2B, which means that the above peeling or sliding deformation will not occur easily and the strength of the core member will improve as a result.

Additionally, the fact that the oxide layer 220 contains Si, as well as at least one of Cr and Al, reduces the rate of movement of oxygen in the layer, which also contributes to the inhibition of lowering of magnetic properties that would otherwise be caused by oxygen reaching the soft magnetic alloy grain 210, and oxidizing Fe.

Furthermore, the fact that the content of Si based on mass is higher than the total content of Cr and Al in the oxide layer 220 also contributes to the achievement of excellent electrical insulating property across the oxide layer 220 and core member 2 as a whole. In addition, it is preferable that the content of Cr and Al is smaller than that of Si in the oxide layer 220, because it means that an oxide layer 220 of small thickness has been obtained due to suppressed diffusion of Cr or Al that diffuses more easily to the oxide layer 220 than does Si in the heat treatment with the presence of oxygen during the manufacture of the magnetic body, and a consequent decrease in the diffusion flux from the soft magnetic alloy grain 210 to the oxide layer 220.

Preferably the oxide layer 220 contains Si in the largest quantity based on mass, has a Si-enriched area 221 where the content of this Si is at least three times as high as the element—among Fe, Cr, and Al— whose content is the second highest to Si based on mass, and contacts the soft magnetic alloy 210 at the Si-enriched area 221. When the oxide layer 220 has such structure, superior electrical insulating property will be achieved. More preferably there are locations where the content of Si based on mass is at least five times as high as the element whose content is the second highest to Si, or even more preferably there are locations where this multiple is 10 times or more, in the Si-enriched area 221.

Figure 3:
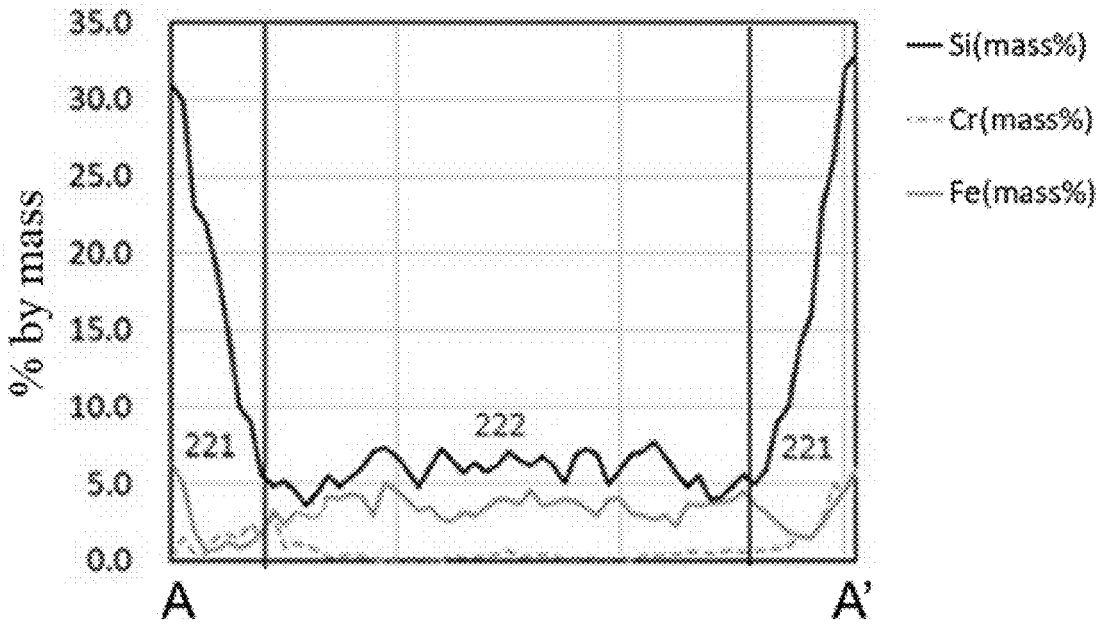
FIG. 3 is results of line analysis along A-A' in FIG. 2A.

Furthermore, the oxide layer 220 is such that, as shown in FIG. 3, the content of Si becomes lower in a Si-rich area 222 that manifests near its center part, than in the Si-enriched area 221. The content of Si in the Si-enriched area 221 is preferably 1.5 times or more, or more preferably 2 times or more, or yet more preferably 3 times or more, than the content of Si in the Si-rich area 222. When the oxide layer 220 has such structure, superior electrical insulating property will be achieved and the film thickness can also be reduced.

In addition, preferably the oxide layer 220, as shown in FIG. 3, contains Si in the largest quantity based on mass over its entirety. When the oxide layer 220 has such structure, superior electrical insulating property will be achieved and the film thickness can also be reduced.

Also, as shown in FIGS. 2A and 2B, preferably the core member 2 further has an Fe-rich layer 230 containing Fe by a largest quantity, among Fe, Si, Cr, and Al, by mass on the surface side, or specifically on the side not contacting any soft magnetic alloy grain 210, of the oxide layer 220 bonding soft magnetic alloy grains 210 together. When the core member 2 has the Fe-rich layer 230, the internal voids will decrease and the strength will improve further. More preferably the core member 2 has an oxide film formed on its exterior surface, whose primary component is Fe derived from the Fe-rich layer 230. Because of this oxide film, the mechanical strength of the core member 2 can be increased further.

Here, the composition of the soft magnetic alloy grain 210, and the structure of the oxide layer 220, in the core member 2, are confirmed according to the procedures below.

First, a thin sample of 50 to 100 nm in thickness is taken from the center part of the core member 2 using a focused ion beam (FIB) device, and immediately thereafter a composition mapping image near the oxide layer 220 is captured per the STEM-EDS method using a scanning transmission electron microscope (STEM) equipped with an annular dark-field detector and an energy-dispersive X-ray spectroscopy (EDS) detector. As for the STEM-EDS measurement conditions, the acceleration voltage is set to 200 kV and the electron beam diameter, to 1.0 nm, with the measurement time set in such a way that the integral count of signal strengths that fall in the range of 6.22 to 6.58 keV at each point in the soft magnetic alloy grain 210 becomes 25 or greater. Then, the area where the ratio of the signal strength of the OKα ray to the total sum of the signal strength of the FeKα ray ($I_{FeK\alpha}$), signal strength of the CrKα ray ($I_{CrK\alpha}$) and signal strength of the AlKα ray ($I_{AlK\alpha}$), or ($I_{OK\alpha}/(I_{FeK\alpha}+I_{CrK\alpha}+I_{AlK\alpha})$), is 0.5 or greater is recognized as the oxide layer 220, while the area where this value is less than 0.5 is recognized as the soft magnetic alloy grain 210.

The composition of the soft magnetic alloy grain 210 is determined by conducting line analysis of the area recognized as the soft magnetic alloy grain 210 based on the aforementioned signal strength ratio, in the diameter direction from the oxide layer 220 side according to the STEM-EDS method, to measure the distributions of Fe, Si, Cr, and Al, and then calculating the average value of content of each element for the first three measuring points where the content of each such element varies by no more than ±1 percent by mass. It should be noted that, if the composition of the soft magnetic alloy powder used in the manufacture of the core member 2 is known, the known composition may be used as the composition of the soft magnetic alloy grain 210.

The structure of the oxide layer 220 is confirmed by conducting line analysis according to the STEM-EDS method along a line segment—in an arbitrary part of the area recognized as the oxide layer 220 based on the aforementioned signal strength ratio, where soft magnetic alloy grains 210 are bonded together—continuing from one soft magnetic alloy grain 210 to another soft magnetic alloy grain 210 via the oxide layer 220, and then measuring the distribution of each element.

[Method for Manufacturing Winding-Type Coil Component]

The method for manufacturing winding-type coil component pertaining to the second aspect of the present invention (hereinafter also referred to simply as "second aspect") includes: preparing a soft magnetic alloy powder which contains Fe, Si, and at least one of Cr and Al, as constituent elements and whose content of Si is higher than the total content of Cr and Al; compacting the soft magnetic alloy powder to obtain a compact corresponding to the shape of the core member; heat-treating the compact in an atmosphere of 5 to 800 ppm in oxygen concentration at a temperature of 500 to 900° C. to form an oxide layer on the surfaces of soft magnetic alloy grains, thereby causing the soft magnetic alloy grains to bond together via the oxide layer, to obtain a core member; forming a pair of terminal electrodes, each using either an end part of a coil conductive wire or a metal part provided separately therefrom; and winding the coil conductive wire around the winding core part of the core member.

The soft magnetic alloy powder used in the second aspect is such that it contains Fe, Si, and at least one of Cr and Al, as constituent elements, and its content of Si is higher than the total content of Cr and Al.

Because the soft magnetic alloy powder contains at least one of Cr and Al, the oxide layer will be inhibited from becoming excessively thick in the below-mentioned heat treatment, allowing for increase in the strength of the core member to be obtained.

Also, because the soft magnetic alloy powder contains more Si than the total of Cr and Al, the oxide layer to be formed by the below-mentioned heat treatment will have a higher percentage by mass of Si relative to the total of Cr and Al. As a result, the strength of the core member can be increased, and insulation between soft magnetic alloy grains can also be ensured, even when the oxide film is thin. In addition, oxidation of Cr or Al can be inhibited during the below-mentioned heat treatment, thereby preventing increase in the thickness of the oxide layer.

The composition of the soft magnetic alloy powder used is not limited in any way, so long as the aforementioned requirements are satisfied, and it may be, for example, one where Si is contained by 1 to 10 percent by mass, Cr, if contained, is contained by 0.5 to 5 percent by mass, and Al, if contained, is contained by 0.2 to 3 percent by mass, with Fe and unavoidable impurities (including, e.g., oxygen, hydrogen, nitrogen and unavoidable metal element impurities) accounting for the remainder. So that the oxide layer to be formed by the heat treatment will have a higher percentage by mass of Si relative to the total of Cr and Al, preferably the total quantity of Cr and Al is adjusted to 4 percent by mass or less. Additionally, to achieve particularly excellent magnetic properties by inhibiting the reaction of Cr or Al with oxygen relative to the reaction of Si with oxygen during the heat treatment, more preferably the total quantity of Cr and Al is adjusted to 2 percent by mass or less. Furthermore, it is particularly preferred that, if the soft magnetic alloy powder contains Al, its content is adjusted to 1 percent by mass or less because Al diffuses more easily on the grain surface than does Cr.

It should be noted that, needless to say, the soft magnetic alloy powder may contain elements other than those mentioned above.

The grain size of the soft magnetic alloy powder used is not limited in any way, either, and the average grain size calculated from the granularity distribution measured on volume basis (median diameter ($D_{50}$)) may be adjusted to 0.5 to 30 μm, for example. Preferably the average grain size is adjusted to 1 to 10 μm. This average grain size may be measured using, for example, a granularity distribution measuring device that utilizes the laser diffraction/scattering method.

In the second aspect, it is possible, before the prepared soft magnetic alloy powder is compacted, to heat-treat the alloy powder at a temperature of 600° C. or above in an atmosphere of 5 to 500 pm in oxygen concentration. The heat treatment forms a smooth oxide film having fewer concavities and convexities on the surfaces of the grains constituting the soft magnetic alloy powder, which will improve the compactability and thereby increase the filling rate. Also, a core member offering excellent electrical insulating property can be obtained.

The upper limit of the aforementioned heat treatment temperature is not limited in any way; from the viewpoint of inhibiting oxidation of Fe, as well as excessive oxidation of Cr or Al; however, it is set preferably to 900° C. or below, or more preferably to 850° C. or below, or yet more preferably to 800° C. or below.

Preferably the aforementioned oxide film is such that the ratio of the mass of Si to the total mass of Cr and Al (Si/(Cr+Al)), at the topmost surface, is 1 to 10. This will increase the evenness of the oxide film thickness to allow for prevention of any strength variation attributable to the dimensions of the magnetic body. As a result, magnetic bodies of different dimensions can be produced based on the same design. Also, if the ratio is 1 or higher, the film will have a smoother surface having even fewer minute concavities and convexities. If the ratio is 10 or lower, on the other hand, excessive oxidation is inhibited and the film stability will improve further, even though the oxide film is thin. The ratio is preferably 8 or lower, or more preferably 6 or lower.

Here, the ratio of the mass of Si to the total mass of Cr and Al at the topmost surface of the oxide film (Si/(Cr+Al)) is measured by the following method. Using an X-ray photoelectron spectrometer (PHI Quantera II, manufactured by ULVAC-PHI, Inc.), the content percentages (percent by atom) of iron (Fe), silicon (Si), oxygen (O), chromium (Cr), and aluminum (Al) are measured at the surface of the soft magnetic alloy grain on which an oxide film has been formed. As for the measurement conditions, the monochromatized AlKα ray is used as an X-ray source, and the detection area is set to 100 μmØ. Then, from the obtained results, the percentages by mass (percent by mass) of the respective elements are calculated and, based on the results thereof, the ratio of the mass of Si to the total mass of Cr and Al is calculated.

Preferably the aforementioned heat treatment prior to compacting is performed in a manner adjusting the percentage by mass of Si at the topmost surface of the oxide film to at least five times the level in the soft magnetic alloy part, while adjusting the percentage by mass of Cr and Al at the topmost surface of the oxide film to at least three times the level in the soft magnetic alloy part. By adjusting the percentages by mass this way, superior flowability can be achieved.

Also, preferably the aforementioned heat treatment prior to compacting is performed in such a way that, when the concentrations of Si, Cr, and Al at the topmost surface of each grain constituting the soft magnetic alloy powder before heat treatment, indicated in percent by mass, are given by [Si before treatment], [Cr before treatment], and [Al before treatment], respectively, while the concentrations of Si, Cr, and Al at the topmost surface of each grain constituting the soft magnetic alloy powder after heat treatment, indicated in percent by mass, are given by $[Si_{after\ treatment}]$, $[Cr_{after\ treatment}]$, and $[Al_{after\ treatment}]$, respectively, then $\{([Cr_{after\ treatment}]+[Al_{after\ treatment}])/([Cr_{before\ treatment}]+[Al_{before\ treatment}])\}>([Si_{after\ treatment}]/[Si_{before\ treatment}])$ is satisfied, or specifically, the percentage of increase in the total quantity of Cr and Al at the topmost surface of the grain due to heat treatment becomes greater than the percentage of such increase in the quantity of Si. By performing the heat treatment this way, a soft magnetic alloy powder having a more stable oxide film can be obtained.

Here, it should be noted that the values of $[Si_{after\ treatment}]$, $[Cr_{after\ treatment}]$, and $[Al_{after\ treatment}]$ above represent the results obtained by analyzing the topmost surface of the oxide film, using the aforementioned X-ray photoelectron spectrometer, with respect to the soft magnetic alloy powder that has been heat-treated prior to compacting, while the values of $[Si_{before\ treatment}]$, $[Cr_{before\ treatment}]$, and

[$Al_{before\ treatment}$] above represent the values obtained from such analysis by changing the measurement sample to the grain constituting the soft magnetic alloy powder before heat treatment.

Also, preferably the aforementioned heat treatment prior to compacting is performed in such a way that the relationship of the specific surface area S ($m^2/g$) and average grain size $D_{50}$ (μm) of the soft magnetic alloy powder will satisfy Formula (1) below.

[Math. 1]

$$\log S \leq -0.98 \log D_{50} + 0.34 \quad (1)$$

This formula is derived based on the empirical rule that the common logarithm of specific surface area S ($m^2/g$), and the common logarithm of average grain size $D_{50}$ (μm), have a linear relationship. Since the value of specific surface area of a powder is affected not only by the surface concavities and convexities of the grains constituting the powder, but also by the sizes of the grains, it cannot be asserted that a powder with a smaller value of specific surface area is constituted by smooth grains having fewer surface concavities and convexities. Accordingly, in the second aspect, the impact of the surface condition of the grain, and the impact of the grain size, on the specific surface area, are isolated according to Formula (1) above, and a soft magnetic alloy powder having a smaller specific surface area due to the former impact is considered to have a smooth surface with fewer concavities and convexities. When the relationship of S and $D_{50}$ satisfies Formula (1) above, the powder will have excellent flowability.

The specific surface area S ($m^2/g$) can be decreased further by increasing the percentage of Si present in the oxide film on the grain surface and reducing the surface concavities and convexities of the oxide film. According to an oxide film having fewer surface concavities and convexities, insulation can be maintained with a smaller film thickness, which is preferred. The percentage of Si present in the oxide film on the grain surface can be increased, as mentioned above, by raising the composition ratio of Si in the soft magnetic alloy powder or lowering the heat treatment temperature. To be specific, the relationship between the specific surface area S ($m^2/g$) and the average grain size $D_{50}$ (μm) preferably satisfies Formula (2) below, or more preferably satisfies Formula (3) below.

[Math. 2]

$$\log S \leq -0.98 \log D_{50} + 0.30 \quad (2)$$

[Math. 3]

$$\log S \leq -0.98 \log D_{50} + 0.25 \quad (3)$$

Here, the specific surface area S is measured/calculated with a fully-automated specific surface area measuring device (Macsorb, manufactured by MOUNTECH Co., Ltd.) using the nitrogen gas adsorption method. First, the measurement sample is deaerated in a heater, after which nitrogen gas is adsorbed and desorbed onto/from the measurement sample, to measure the adsorbed nitrogen quantity. Next, the monomolecular layer adsorption quantity is calculated from the obtained adsorbed nitrogen quantity using the BET 1-point method, and from this value, the surface area of the sample is derived using the area occupied by one nitrogen molecule and the value of Avogadro's number. Lastly, the obtained surface area of the sample is divided by the mass of the sample, to obtain the specific surface area S of the powder.

Also, the average grain size $D_{50}$ is measured/calculated with a granularity distribution measuring device (LA-950, manufactured by Horiba, Ltd.) that utilizes the laser diffraction/scattering method. First, water is put in a wet flow cell as a dispersion medium, and the powder that has been fully crushed beforehand is introduced to the cell at a concentration that allows appropriate detection signals to be obtained, in order to measure the granularity distribution. Next, the median diameter is calculated from the obtained granularity distribution, and this value is defined as the average grain size $D_{50}$.

Furthermore, preferably the aforementioned heat treatment prior to compacting is performed in such a way that the thickness of the oxide film to be formed thereby will become 10 to 50 nm. When the thickness of the oxide film is adjusted to 10 nm or more, a smooth surface covering the minute concavities and convexities of the alloy part can be formed. Also, high insulating property can be achieved. More preferably the thickness of the oxide film is adjusted to 20 nm or more. This way, the ratio of Si at the oxide film surface can be increased. Also, insulating property can be maintained even when defects occur in the oxide film, when the core member is formed, as a result of compression molding that involves application of pressure. When the thickness of the oxide film is adjusted to 50 nm or less, on the other hand, drop in the smoothness of the grain surface due to uneven film thickness can be inhibited. Also, high magnetic permeability can be achieved once the core member has been formed. More preferably the thickness of the oxide film is adjusted to 40 nm or less.

Here, the thickness of the oxide film is calculated by observing a cross section of magnetic grains constituting the soft magnetic alloy powder using a scanning transmission electron microscope (STEM) (JEM-2100F, manufactured by JEOL Ltd.), measuring the thickness of the oxide film as recognized by a contrast (brightness) difference (attributed to different compositions) from the alloy part inside the grain, at 10 locations on different grains at a magnification of 500,000 times, and then averaging the results.

The second aspect includes compacting the prepared soft magnetic alloy powder to obtain a compact that corresponds to the shape of the core member. Examples of compacting methods include one whereby a thermoplastic resin or other binder is added to the soft magnetic alloy powder and mixed together under agitation to obtain granules, after which the granules are introduced to a die and press-formed.

At this time, a drum-type core member can be obtained by simply putting the compact obtained by press-forming through centerless grinding using an abrasive disc, etc., and forming concave parts corresponding to the winding core part, for example. It should be noted that how a drum-type compact is obtained that has concave parts corresponding to the winding core part, is not limited to this method and, for example, the aforementioned granules may be press-formed using a die having a drum-type compacting space, into a drum-type compact.

If a binder is added when compacting the soft magnetic alloy powder in the second aspect, the binder to be used is not limited in any way so long as it can bond the soft magnetic alloy powder grains together to form and retain a shape, while volatilizing through a degreasing process without leaving any carbon content, etc., behind. Examples include acrylic resins, butyral resins, vinyl resins, etc., with a decomposition temperature of 500° C. or below. Also, any lubricants, representative examples of which include stearic acid and salts thereof, phosphoric acid and salts thereof, and boric acid and salts thereof, may be used together with, or instead of, the resin.

The additive quantity of the resin or lubricant only needs to be determined as deemed appropriate by considering the formability, shape retainability, etc., and may be, for example, 0.1 to 5 parts by mass relative to 100 parts by mass of soft magnetic alloy powder.

In the second aspect, which involves heat-treating the aforementioned compact, preferably degreasing is performed prior to heat treatment if a binder is mixed in when the compact is obtained. The degreasing temperature, which is set according to the decomposition temperature of the resin used, is generally around 200 to 500° C. Also, preferably the degreasing atmosphere is superheated steam so as to prevent oxidation of the soft magnetic alloy.

The second aspect includes heat-treating the aforementioned compact in an atmosphere of 5 to 800 ppm in oxygen concentration.

By adjusting the oxygen concentration in the heat treatment atmosphere to the aforementioned range, a Si-rich oxide layer containing Si, as well as at least one of Cr and Al, can be formed to an appropriate thickness on the surfaces of the soft magnetic alloy grains. The oxygen concentration is preferably 100 ppm or higher, or more preferably 200 ppm or higher.

If the oxygen concentration in the heat treatment atmosphere is too low, a short period of heat treatment will result in insufficient formation of oxide layer and consequent lowering of insulating property, while a long period of heat treatment will make the oxide layer too thick due to diffusion of Fe, Cr, or Al into the oxide layer and the strength and magnetic permeability of the core member will drop as a result. If the oxygen concentration in the heat treatment atmosphere is too high, on the other hand, the content of Fe, Cr, or Al in the oxide layer will increase too much, which will increase the number of oxide layers and layer thickness, and thus cause the strength of the core member to drop, while also causing the insulating property of the oxide layer to drop.

Also, in the second aspect, the aforementioned heat treatment is performed at a temperature of 500 to 900° C.

By adjusting the heat treatment temperature to the aforementioned range, a Si-rich oxide layer containing Si, as well as at least one of Cr and Al, can be formed to an appropriate thickness on the surfaces of the soft magnetic alloy grains. The temperature of the aforementioned heat treatment is preferably 550° C. or above, or more preferably 600° C. or above. Also, the temperature of the aforementioned heat treatment is preferably 850° C. or below, or more preferably 800° C. or below.

The heat treatment period in the second aspect is not limited in any way, so long as a Si-rich oxide layer containing Si, as well as at least one of Cr and Al, is formed on the surfaces of the soft magnetic alloy grains and the soft magnetic alloy grains can be bonded together via the oxide layer; however, it is set preferably to 30 minutes or longer, or more preferably to 1 hour or longer, from the viewpoint of ensuring that the oxide layer will have a sufficient thickness. From the viewpoint of completing the heat treatment quickly and thereby improving productivity, on the other hand, the heat treatment period is set preferably to 5 hours or shorter, or more preferably to 3 hours or shorter.

The heat treatment in the second aspect may be a batch process or flow process. Examples of a flow process include a method whereby multiple heat-resistant trays, each carrying the aforementioned compact, are introduced into a tunnel furnace either intermittently or successively, to have them pass through an area, which is kept at a prescribed atmosphere and a prescribed temperature, over a prescribed period of time.

The second aspect may further include, after the aforementioned heat treatment, a second heat treatment performed in an atmosphere of 5 to 800 ppm in oxygen concentration and at a temperature of 500 to 600° C. which is also lower than the aforementioned heat treatment temperature. By performing the second heat treatment, an Fe-rich layer can be formed thickly which contains Fe by a largest quantity, among Fe, Si, Cr, and Al, by mass on the side of the oxide layer not contacting the soft magnetic alloy grain. As a result, the voids in the magnetic layer will decrease and the strength of the core member will improve further.

If the second heat treatment is performed, preferably it is performed using the same device described for the aforementioned heat treatment and also successively following the heat treatment, from the viewpoint of manufacturing efficiency.

The second aspect includes forming a pair of terminal electrodes, each using either an end part of a coil conductive wire or a metal part provided separately therefrom.

Regarding the method for providing a metal part on the surface of the core member for use as a terminal electrode, various techniques may be applied including a method of applying and baking an electrode paste, a method of bonding an electrode frame with an adhesive, and a method of forming a thin conductor film according to the sputtering method, vapor deposition method, etc., and the like.

In the case of applying and baking an electrode paste, first an electrode paste containing conductor powder, glass frit, and organic vehicle is applied on the exterior surface of the core member. It should be noted here that, regarding the method for applying the electrode paste, the roller transfer method, pad transfer method, or other transfer method, the screen-printing method, stencil-printing method, or other printing method, or the spray method, inkjet method, etc., may be applied, for example. Next, the core member on which the electrode paste has been applied, is heat-treated to form a terminal electrode. Here, regarding the conditions for heat treatment, performing it under a temperature condition of 750 to 900° C. in the air or in a $N_2$ gas atmosphere of 5 ppm or lower in oxygen concentration, is given as an example.

It should be noted that the method for forming a terminal electrode is not limited to the aforementioned methods, and the film may be removed from an end part of the coil conductive wire to use the exposed area as a terminal electrode.

If a terminal electrode is formed by a metal part, an end of the coil conductive wire is electrically connected to the metal part.

For the connection method, the following method is given as an example. First, the insulating film is stripped/removed from an end part of the coil conductive wire wound around the core member. To be specific, a method may be adopted, for example, whereby a film-stripping solvent is applied or a laser beam of prescribed energy is irradiated onto the end part of the coil conductive wire in order to dissolve or evaporate, and thereby completely strip/remove, the resin material forming the insulating film near the end part of the coil conductive wire. Next, the end part of the coil conductive wire from which the insulating film has been stripped/removed, is soldered to each terminal electrode to achieve conductive connection. To be specific, the end part of the coil conductive wire is placed on each terminal electrode and a solder paste containing flux is applied on the coil conductive wire and each such terminal electrode using the stencil printing method, etc., after which a hot plate that has been heated to 200 to 250° C. is used to hot-press the solder to let it melt/adhere, thereby joining the end part of the coil conductive wire to each terminal electrode. Lastly, a cleaning process is performed to remove flux residue from the joined area.

The second aspect includes winding the coil conductive wire around the winding core part of the core member.

Regarding the method for winding the coil conductive wire, the following method is given as an example that relates to a drum-type core. First, the top flange part of the core member (flange part that is positioned on the top side when the winding-type coil component is mounted) is affixed in the chucks of a winding device in such a way that the winding core part of the core member is exposed. Next, a sheathed conductive wire is tentatively fixed onto one terminal electrode that has been formed on the bottom flange part, and in this condition, the sheathed conductive wire is cut and this part is used as one end side of the coil conductive wire. Next, the chucks are rotated to wind the sheathed conductive wire around the winding core part by a prescribed number of times. Lastly, the sheathed conductive wire is tentatively fixed onto the other terminal electrode that has been formed on the bottom flange part, and in this condition, the sheathed conductive wire is cut and this part is used as the other end side of the coil conductive wire, to obtain a core member with the coil conductive wire wound around its winding core part.

In the second aspect, the outer periphery of the coil conductive wire that has been wound around the winding core part, may be covered with an exterior member.

For the covering method, the following method is given as an example that relates to a drum-type core. First, a paste of a magnetic powder-containing resin that contains a magnetic powder having the same composition as the soft magnetic alloy grains that constitute the core member, is discharged onto the area between the flange parts of the core member using a dispenser, to fill the area in a manner covering the outer periphery of the coil conductive wire. Next, the paste of magnetic powder-containing resin is heated for approx. 1 hour at a temperature of approx. 150° C. to be cured, in order to form an exterior member covering the outer periphery of the coil conductive wire.

[Circuit Board]

The circuit board pertaining to the third aspect of the present invention (hereinafter also referred to simply as "third aspect") is a circuit board carrying the winding-type coil component pertaining to the first aspect.

The circuit board is not limited in structure, etc., and anything that fits the purpose may be adopted.

The third aspect achieves high durability and reliability by using the winding-type coil component of excellent mechanical strength pertaining to the first aspect.

EXAMPLE

The present invention is explained more specifically below using an example; it should be noted, however, that the present invention is not limited to this example.

Example

In this example and the comparative example described below, magnetic bodies having desired structures and element distributions were obtained by heat treatment in a low-oxygen atmosphere, and these magnetic bodies were confirmed as having higher strength using test pieces.

(Preparation of Test Piece)

First, a soft magnetic alloy powder having a composition of Fe-3.5Si-1.5Cr (the numerical values indicate percent by mass) and an average grain size of 4.0 μm was prepared. Next, this soft magnetic alloy powder was mixed under agitation with an acrylic binder of 1.2 percent by mass, to prepare a compacting material. Next, this compacting material was introduced into a die having a compacting space of rectangular solid shape, and then uniaxially press-formed at a tonnage of 8 t/cm$^2$, to obtain a rectangular solid compact of 40.0 mm in length, 4.0 mm in width, and 3.0 mm in thickness. Next, the obtained compact was placed for 1 hour in a thermostatic chamber kept at 150° C. to cure the binder, and then heated to 300° C. in a superheated steam furnace to remove the binder by means of pyrolysis. Next, using a quartz furnace, the compact was heat-treated at 800° C. for 1 hour in an atmosphere of 800 ppm in oxygen concentration, to obtain the test piece pertaining to the example.

(Confirmation of Oxide Layer Structure)

The obtained test piece was confirmed, according to the method described above, for the structure of the oxide layer bonding the soft magnetic alloy grains together. A schematic representation of the STEM-observed structure of the oxide layer is shown in FIGS. 2A and 2B, while the results of line analysis along line segment A-A' in FIG. 2A are shown in FIG. 3.

According to FIG. 3, clearly the oxide layer 220 contains Si, as well as Fe and Cr. Also, the content of Si is higher than the content of Cr over nearly the entire width of the oxide layer 220, which makes it clear that, in the oxide layer 220, the content of Si based on mass is higher than the total content of Cr and Al. Furthermore, in the oxide layer 220, a Si-enriched area 221 of particularly high Si content was found at the boundary part with the soft magnetic alloy grain 210. In this area, there were locations where the content of Si was approximately five times that of Fe contained in the second largest quantity.

Also, in FIGS. 2A and 2B, presence of an Fe-rich layer 230 of particularly high Fe content was also found on the side of the oxide layer 220 not contacting the soft magnetic alloy grain 210.

(Strength Evaluation of Test Piece)

The obtained test piece was evaluated for strength, in a 3-point flexural test according to JIS R 1601:2008 (Testing Method for Flexural Strength of Fine Ceramics at Room Temperature), based on the maximum load under which the test piece failed. The obtained maximum load was 15 N.

Comparative Example

The test piece pertaining to the comparative example was obtained in the same manner as in the example, except that the heat treatment conditions for the compact were changed to 750° C. for 1 hour in the air.

When the structure of the oxide layer in the obtained test piece was confirmed according to the same method in the example, the oxide layer contained Si, as well as Fe and Cr, and Si was contained in the largest quantity in the boundary part with the soft magnetic alloy grain; however, Cr was found most abundant in the majority of the areas on the interior side thereof, and the content of Cr was the highest on the whole. Also, the oxide layer had a five-layer structure as shown in FIG. 4, and its thickness was approx. 100 nm.

When the obtained test piece was measured for strength according to the same method in the example, the maximum load was 12 N.

It can be argued, from comparing the example and the comparative example, that a magnetic body whose oxide layer bonding the soft magnetic alloy grains together contains Si, as well as at least one of Cr and Al, and whose content of Si is higher than the total content of Cr and Al, exhibits high mechanical strength. This is understood to be the result of the aforementioned oxide layer being constituted by a small number of layers and having a small overall thickness, which resulted in improved mechanical strength of the oxide layer. It can be argued that a winding-type coil component that contains a core member formed with a magnetic body of high mechanical strength, is resistant to cracking, chipping, and other handling damage. Particularly with a winding-type coil component having a drum-type core member, a prominent effect of inhibiting damage to the flange parts that project from the winding core part, can be expected.

In this disclosure, "a" may refer to a species or a genus including multiple species, "the invention" or "the present invention" may refer to at least one of the aspects or embodiments explicitly, necessarily, or inherently disclosed herein, and likewise, "the aspect" may refer to at least one of the embodiments or examples explicitly, necessarily, or inherently disclosed herein.

INDUSTRIAL APPLICABILITY

According to the present invention, a winding-type coil component of high mechanical strength is provided. This coil component is useful in the sense that its core member is inhibited from cracking or chipping due to handling, which facilitates the operation of mounting the coil component onto a circuit board or the handling of a circuit board on which the coil component has been mounted. Additionally, the winding-type coil component according to a preferred mode of the present invention is useful in the sense that a coil component offering excellent characteristics can be obtained owing to the high magnetic permeability of the core member, and also in the sense that the coil component permits size reduction because the element volume needed to achieve the same characteristics can be reduced. Furthermore, the winding-type coil component according to another preferred mode of the present invention is useful also in the sense that it offers high current capacity owing to the high insulating property of the core member.

We claim:

1. A winding-type coil component comprising: a core member having a winding core part of a columnar shape; a coil conductive wire wound around the winding core part of the core member; and a pair of terminal electrodes, each constituted by either an end part of the core conductive wire or a metal part to which the end part is connected;

wherein the core member is constituted by:

soft magnetic alloy grains containing Fe, Si, and at least one of Cr and Al, as constituent elements; and an oxide layer which is formed around the soft magnetic alloy grains to bond the soft magnetic alloy grains together and contains Si, as well as at least one of Cr and Al, as constituent elements, and whose content of Si based on mass is higher than a total content of Cr and Al, wherein the oxide layer is comprised of a Si-enriched layer and a Si-rich layer where the soft magnetic alloy grains are bonded together, wherein:

the Si-rich layer contains Si by a largest quantity, among Fe, Si, Cr, and Al, by mass, the content of Si of the Si-enriched layer is at least 1.5 times higher than the content of Si of the Si-rich layer, and the Si-enriched layer is formed on and in contact with the soft magnetic alloy grains, and the Si-rich layer is formed on and in contact with the Si-enriched layer on a side of the Si-rich layer opposite to the soft magnetic alloy grains.

2. The winding-type coil component according to claim 1, which further has an Fe-rich layer containing Fe by a largest quantity, among Fe, Si, Cr, and Al, by mass on a side of the oxide layer not contacting any soft magnetic alloy grain.

3. The winding-type coil component according to claim 1, wherein a composition of the soft magnetic alloy grains is such that Si is contained by 1 to 10 percent by mass, Cr and Al are contained by 0.2 to 2 percent by mass in total, and Fe and unavoidable impurities account for a remainder.

4. The winding-type coil component according to claim 3, wherein a content of Al in the soft magnetic alloy grains is 0.2 to 1 percent by mass.

5. A circuit board on which the winding-type coil component of claim 1 is mounted.

6. The winding-type coil component according to claim 1, wherein the oxide layer contains Si by a largest quantity, among Fe, Si, Cr, and Al, by mass throughout the oxide layer.

* * * * *